United States Patent [19]

Sedam

[11] 4,216,885

[45] Aug. 12, 1980

[54] DISPOSABLE PACKAGE FOR DISPENSING LIQUIDS WITH A CONTROLLED RATE OF FLOW

[75] Inventor: Jason K. Sedam, Dunwoody, Ga.

[73] Assignee: The Coca-Cola Company, Atlanta, Ga.

[21] Appl. No.: 953,105

[22] Filed: Oct. 20, 1978

[51] Int. Cl.[2] ..... B67D 3/00

[52] U.S. Cl. ..... 222/481; 222/541; 222/83.5; 222/91

[58] Field of Search ..... 222/83, 88, 81, 80, 222/478, 481.5, 481, 541, 83.5, 91, 89, 90; 215/307

[56] References Cited

U.S. PATENT DOCUMENTS

| | | | |
|---|---|---|---|
| 600,327 | 3/1898 | Winters | 222/481 |
| 1,513,935 | 11/1924 | Schatz | 222/481.5 X |
| 2,283,652 | 5/1942 | Schwarzkopf | 221/67 |
| 2,336,313 | 12/1943 | Swan | 221/39 |
| 2,708,533 | 5/1955 | Nicholas | 222/146 |
| 2,822,962 | 2/1958 | Poitras | 222/481 |
| 3,258,166 | 6/1966 | Kuckens | 222/70 |
| 3,807,607 | 4/1974 | Kuckens | 222/481 |
| 3,991,219 | 11/1976 | Kuckens | 426/442 |

*Primary Examiner*—Allen N. Knowles
*Attorney, Agent, or Firm*—W. Dexter Brooks

[57] ABSTRACT

A disposable package for dispensing liquids with a controlled rate of flow is described, such as for syrup for use with a post-mix soft drink dispenser. The disposable package includes a thin walled plastic or glass container with a closed end and an open end defining a discharge opening with a flow rate control tube positioned in said container in a predetermined position. The flow rate control tube has a closed rupturable, openable or frangible sealed end, which extends through the closed end of the container, and an open end, which is disposed at a predetermined distance within the container from the position of the discharge opening. The discharge or open end of the container is sealed by a removable cap and a rupturable membrane. The sealed end of the flow rate control tube may be contained within a recessed portion of the container adjacent the closed end thereof to protect the sealed end from rupture during shipping of the disposable package. A check valve may be placed at the open end of the flow control tube to preclude spillage in operable condition when the package temperature is elevated and the trapped head-space expands exerting back-pressure.

12 Claims, 7 Drawing Figures

DISPOSABLE PACKAGE FOR DISPENSING LIQUIDS WITH A CONTROLLED RATE OF FLOW

BACKGROUND OF THE INVENTION

1. Field of the Invention

The present invention relates to a disposable package for dispensing liquids with a controlled rate of flow. More specifically, the present invention relates to a disposable syrup package for a post-mix soft drink dispenser having a flow rate control tube formed as a substantially integral part of the syrup container.

2. Description of the Prior Art

Heretofore, the use of a flow rate control tube in the syrup container of a post-mix dispenser for providing an even rate of flow of syrup from the container into a receptacle was generally known. An example of a system of this type is disclosed in U.S. Pat. No. 2,708,533 to Nicholas. Nicholas discloses the broad concept of providing a flow control tube 76 in the syrup tank of a post-mix beverage system having its open or bottom end precisely positioned at a predetermined level above the discharge opening of the tank in order to provide a substantially constant rate of flow of the syrup being dispensed from the tank. The Nicholas patent also discloses in FIG. 2 that the syrup tank of his invention may be a disposable tin can that is filled at a central distributing plant and delivered in a completely sealed condition to the location of the dispensing system. As illustrated in FIG. 2 of Nicholas, the bottom of the tin can is rupturable by puncturing elements associated with the dispenser valve and the top of the can is provided with a knockout 118 into which stopper 74 and flow control tube 76 is inserted just prior to the dispensing operation. The flow control tube 76 is positioned within the container at a predetermined position determined by graduations 124 on the flow control tube which instructs an operator as to the proper position of the tube for preselected different flow rates for syrups of different Brix values.

Although, once the system of Nicholas is assembled, it operates in a very satisfactory manner for controlling flow rate, it does suffer from certain disadvantages. For example, in the Nicholas patent the flow control tube is a completely separate item from the syrup package which is shipped from the distributing plant to the point of use. Thus, the flow control tube 76 in the Nicholas system requires special assembly at the point of use and skilled adjustment of its position within the syrup container. While it might be possible for an operator in a commercial establishment to learn how to properly insert the flow control tube, the occasional user of the system, such as in a home dispenser system, would have difficulty inserting the flow control tube in the correct position for the different Brix values of syrups to be dispensed. In addition, the syrup container of Nicholas could be refilled through the knockout portion 118 which would lead to problems of improper or inadequate sanitation. Still further, if the syrup container of Nicholas rises above a predetermined temperature, syrup will rise up tube 76 and spill over through the top thereof.

Other examples of the use of flow control or vent tubes in syrup packages can be found in U.S. Pat. No. 3,258,166 to Kuckens issued June 28, 1966 and U.S. Pat. No. 3,991,219 to Kuckens issued Nov. 19, 1976. Each of these patents disclose inverted containers having flow control vent tubes formed therein. However, the vent tubes in each of these patents are completely opened to the atmosphere, that is no means are provided for precluding the flow of liquid up the vent tubes. Thus, at elevated temperatures the head-space of gas above the liquid in the containers will create a back-pressure forcing the liquid up the vent tubes causing spillage.

An additional U.S. Pat. No. 3,807,607 to Kuckens issued Apr. 30, 1974 discloses a syrup container 1 having a vent tube 11 therein and a gas responsive check valve 12 in the top of vent tube 11. The check valve 12 of Kuckens is provided to inhibit flow of syrup up tube 11 when container 1 is being refilled in contrast to precluding flow up the tube in response to container 1 being heated to an elevated temperature. Applicant has discovered that the location of valve 12 of Kuckens at the top of tube 11 is unsatisfactory, if fluid flow up the tube 11 were to be caused by an elevated container temperature. In such a case fluid might flow substantially all of the way to valve 12 at the top of vent tube 11 before valve 12 closed. This would result in the accumulation of syrup on the inner walls of tube 11 causing clogging and/or contamination. Moreover, as stated hereinbefore, the Kuckens valve 12 is not disclosed as being provided to preclude flow up tube 11 in response to an elevated container temperature. Therefore, the Kuckens apparatus is not designed to solve the problem embraced by the present invention.

Check valves have also been used heretofore in vent tubes of containers for dispensing products other than syrup. However, these check valves were utilized to preclude spilling of liquid when the container is inverted to an upright nondispensing position. The designers of these prior art devices were not concerned nor cognizant of the problem of fluid spillage of liquid due to an elevated container temperature and a resulting flow of liquid up the vent tube. Examples of such prior art containers can be found in U.S. Pat. Nos. 600,327 to Winters, issued Mar. 8, 1898; 2,283,652 to Schwarzkopf issued May 19, 1942; 2,336,313 to Swan issued Dec. 7, 1943; and 2,822,962 to Poitras issued Feb. 11, 1958.

SUMMARY OF THE INVENTION

Accordingly, it is a primary object of the present invention to provide a disposable package for dispensing liquids with a controlled rate of flow, which is completely assembled at the time of shipping and requires no adjustment on the part of the user at the point of use.

It is a further object of the present invention to provide a disposable package for dispensing liquids with a controlled rate of flow which cannot readily be filled for reuse.

It is still a further object of the present invention to provide a syrup dispensing package including means to preclude overflow or spillage in response to increases in the package temperature above predetermined levels.

It is another object of the present invention to provide a lightweight disposable package for dispensing liquids including means for preventing damage to the package during shipping.

It is still another object of the present invention to provide a disposable package for dispensing liquids with a controlled rate of flow which is lightweight and inexpensive to manufacture.

The objects of the present invention are fulfilled by providing a disposable syrup package for post-mix dispensers comprising a disposable plastic bottle having relatively thin sidewalls, which incorporates, as a substantially integral part thereof, a tube through one end of the container precisely positioned within the container to establish a controlled rate of flow of the syrup during dispensing. The tube initially has one end extending through the bottom or closed end of the plastic bottle and an opposite end which is open and positioned at a predetermined distance from the discharge end of the bottle, in order to develop an effective hydrostatic pressure head at the point of said predetermined distance. The closed end of the tube is recessed into the end of the bottle through which it extends in order to protect the same from rupture during shipping.

In operation with a conventional post-mix syrup dispenser, the plastic bottle or package of the present invention is inverted and inserted into the valve seat of the dispenser against a sharp piercing device. The piercing device ruptures a membrane extending across the open end of the bottle to form a dispensing outlet. The closed end of the flow control tube is then ruptured or opened to permit the flow of air into the tube. A pressure balance is then created within the bottle as the liquid is withdrawn and replaced by air, and from this point on, the tube in the bottle functions to control the rate of flow of syrup at a substantially constant rate as the contents of the bottle are dispensed.

In a preferred embodiment the flow control tube is provided with a check valve adjacent the open end thereof to preclude syrup from rising up the tube when a predetermined temperature level of the package is exceeded. For temperature below this level the check valve does not impede the flow of air down the tube.

BRIEF DESCRIPTION OF THE DRAWINGS

The objects of the present invention and the attendant advantages thereof will become more readily apparent by reference to the accompanying drawings wherein.

DETAILED DESCRIPTION OF THE PREFERRED EMBODIMENT

Figure 1:
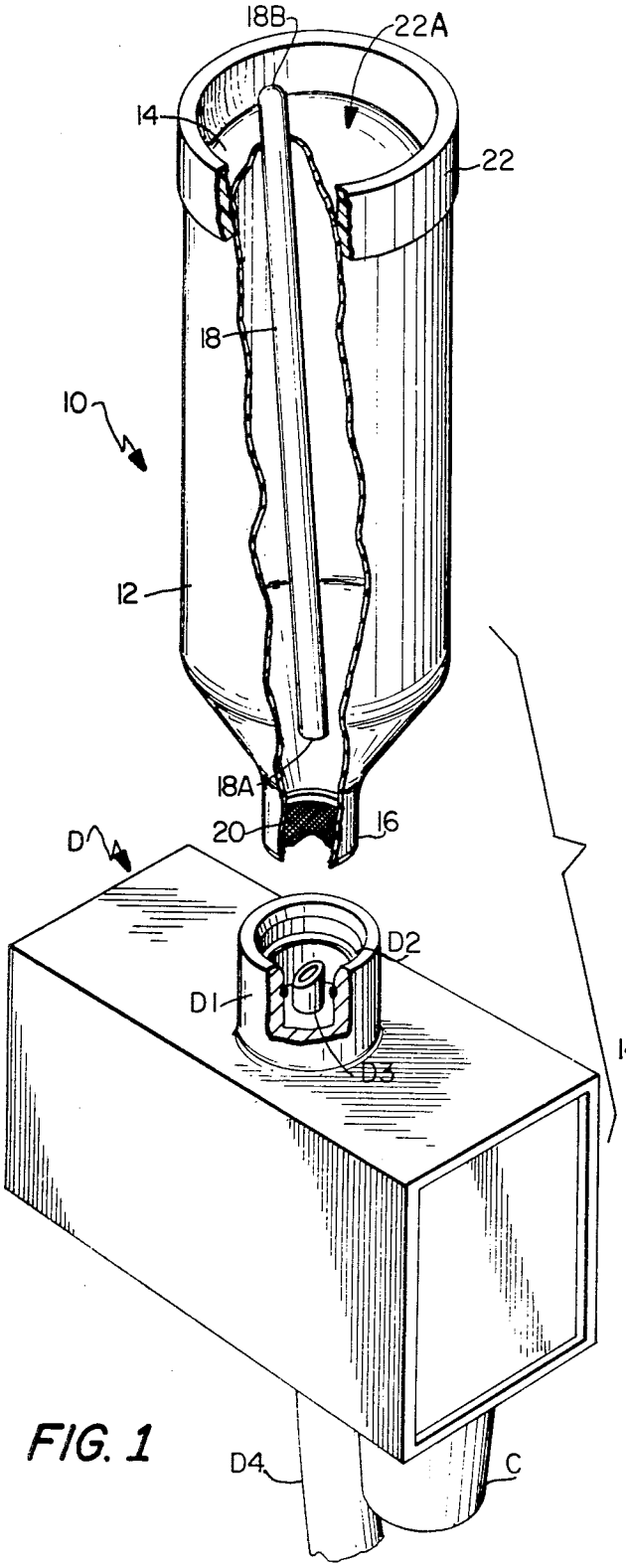
FIG. 1 is a perspective view partially in section illustrating the disposable package of the present invention just prior to insertion into the valve seat of a beverage dispenser system.

Referring in detail to FIG. 1, there is illustrated a disposable package of the present invention generally indicated 10 depicted in a position just prior to its insertion into a dispensing means generally indicated D, such as a post-mix dispenser.

Figure 2:
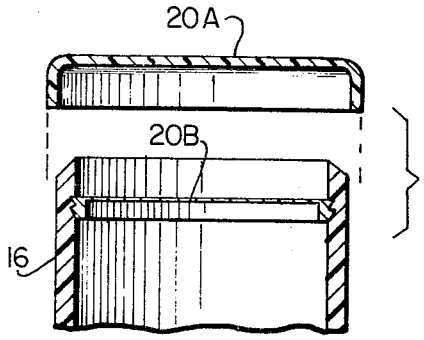
FIG. 2 is an enlarged view in cross section illustrating the details of the closure member for the open end of the disposable package of the present invention.

The disposable package 10 of the present invention includes a plastic bottle or container 12 having thin sidewalls, a closed end 14 and an open end 16 defining a discharge opening of the disposable package. The open end 16 is provided with a closure member 20 including, as illustrated in FIG. 2, an outer closure member 20A which snaps over the end 16 of container 12 and a rupturable membrane such as a metal foil which is secured across the inside or the end of the discharge opening defined by container end 16. A flow control tube 18 is permanently secured at a predetermined position within container 12 and has an open end 18A positioned at a predetermined distance above the discharge opening defined by open end 16 of the container, and a closed but sealed or frangible end 18B which extend through the end portion 14 of the container 12. The closed end portion 18B of tube 18 is disposed within the confines or recess 22A defined by annular skirt member 22 of plastic or other suitable material which is secured to the end of container 12, the recess may be formed as part of the container 12.

The entire package generally indicated 10 in FIG. 1 is manufactured as a substantially integral unit and is shipped as said unit to a point of use as will be described more fully hereinafter. The tube 18 is permanently secured in a fixed position in end wall 14 by a suitable adhesive, sealant or other bonding means. In the alternative, tube 18 could be integrally molded or formed with the end wall 14. A still further alternative is to form the container 12 of material which shrinks after molding, form a hole in the bottom, insert tube 18 to a desired position, and allow the container 12 to shrink around tube 18 to secure it in place.

The dispenser mechanism suitable for use in the present invention is generally indicated D in FIG. 1 and is similar to those used for dispensing post-mix soft drink beverages. This dispenser generally comprises a socket on the upper surface thereof including an upstanding annular sidewall D1 and an O-ring seal D2. Extending upwardly in the socket and located substantially centrally thereof is a piercing device D3. The piercing device D3 is designed to puncture the rupturable membrane 20B sealed across the open end of container 12, as container 12 is lowered or inserted into the socket of the dispenser D. A dispenser lever D4 or other valve-actuating means is provided as is well known for cooperation with a cup into which the post-mix beverage is to be dispensed. A mixing nozzle C is provided should the liquid in the package be mixed with another liquid such as carbonated water.

Figure 3:
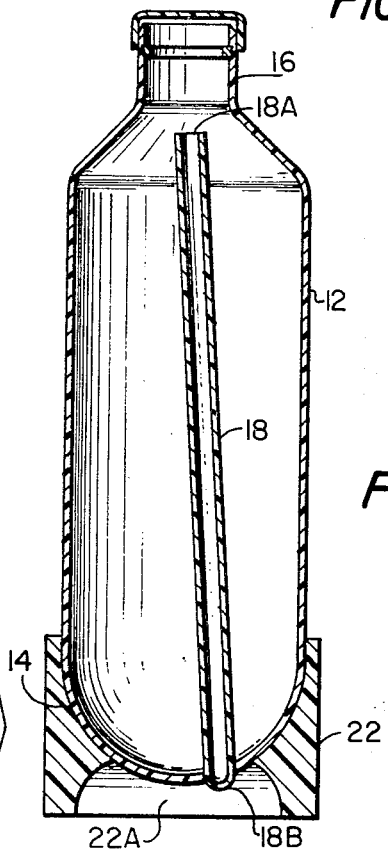
FIG. 3 is a cross-sectional view of the disposable package of the present invention illustrating a first embodiment of a means for preventing damage to the end of the flow control tube of the present invention during shipping of the package.

Referring in detail to FIG. 3, there is illustrated in cross section the annular skirt 22 of the package of FIG. 1 which is suitably secured to closed end 14 of container 12 or is formed as part of the container. The annular skirt 22 defines a recess 22A into which closed end 18B of tube 18 is contained. Since end 18B of tube 18 is frangible or sealed, it is necessary to provide skirt 22, in order to prevent rupturing or damage to end 18B or other seal during shipping and storage of the disposable package 10. The recess is also necessary so that the containers stand upright during shipment, storage or display.

Figure 4:
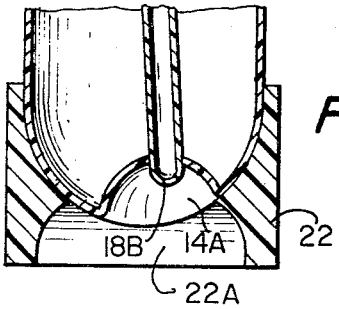
FIG. 4 is a partial cross-sectional view of the disposable package of the present invention illustrating an alternate end configuration of the package for preventing damage to the flow control tube end.

An alternate configuration for the tube end protection means of FIG. 3 is illustrated in FIG. 4 and includes, in addition to the annular skirt 22, a recessed portion 14A in the closed end 14 of container 12 in which the tube end 18B is recessed. It can be seen in both the embodiments of FIG. 3 and FIG. 4, that if the disposable package 10 of the present invention is dropped during shipping, it will most likely land on annular skirt 22 and the rupturing of tube end 18B will be prevented.

The syrup in the container after connecting to the dispenser D is preferably stored in refrigerated condition for use in order that the finished product be most palatable.

It has been found that the opened container 12, after stabilizing at a refrigerated termperature and when subsequently warmed, develops increased pressure in the trapped head-space due to the expansion of the head-space air. The increased head-space pressure will drive syrup back up the tube 18 resulting in spillage through the open end 18B at the top of the tube.

Figure 5:
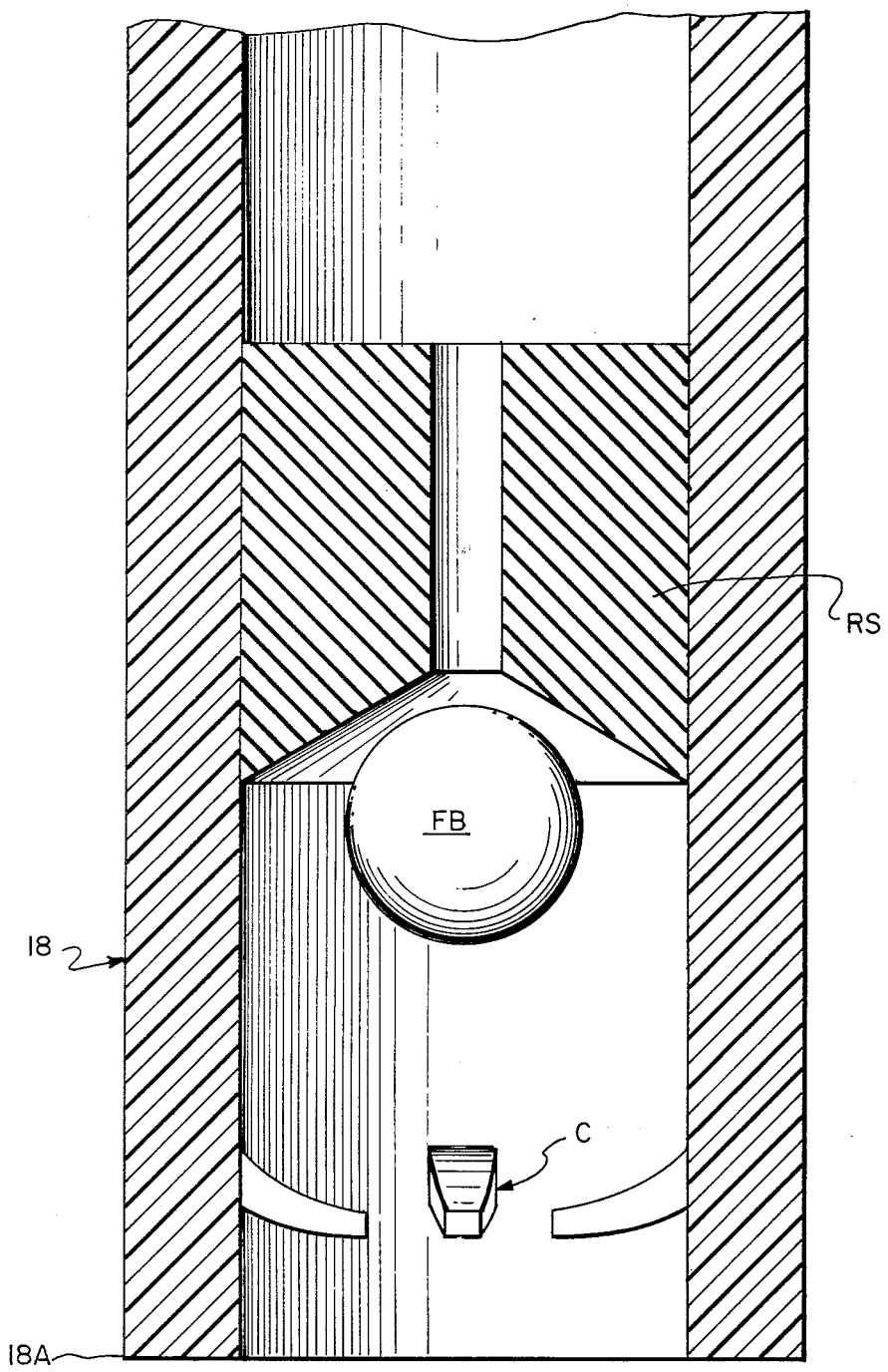
FIG. 5 is a partial section of the flow control tube of the present invention illustrating an additional preferred embodiment thereof.

To counteract this effect, a suitable check valve is provided within the container, preferably at the end of or within the flow rate control tube 18, as illustrated in FIG. 5. One such check valve may consist of a resilient seat RS against which acts a ball FB, suitably caged at C to prevent loss, which floats in the syrup contained in the tube 18. The flotation provides the biasing pressure to effect initial seating of the ball FB on the resilient seat RS when the syrup is being driven up the tube by the increased head-space pressure resulting from warming of the container and its contents. The biasing pressure increases to effect a syrup-tight seal against seat RS as head-space pressure becomes greater due to further warming, thereby stopping the rise of syrup in the tube 18 and resultant spillage.

Figure 6:
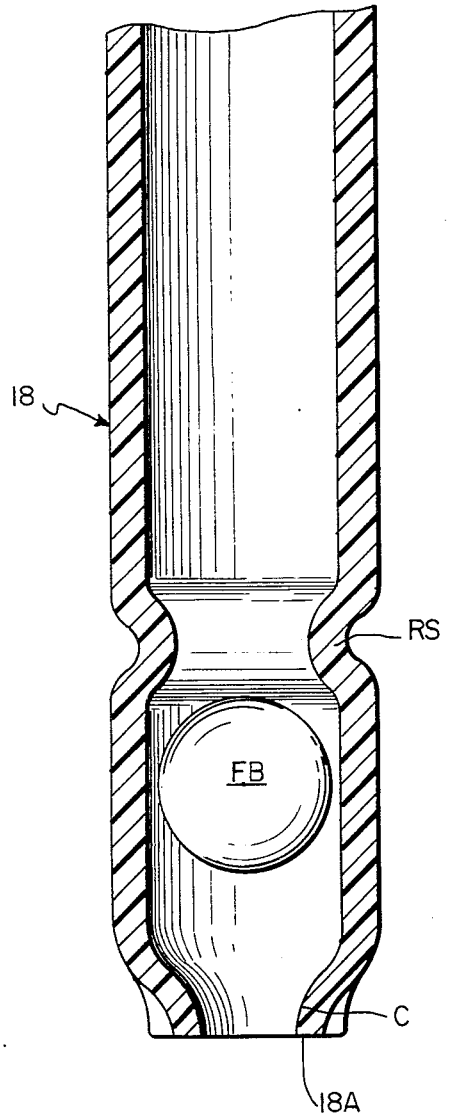
FIG. 6 is a partial sectional view of still another embodiment of the flow control tube of the present invention.
Figure 7:
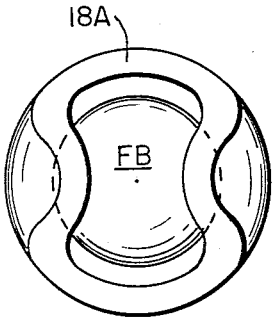
FIG. 7 is a bottom end view of the flow control tube end.

If desired the cage C and valve seat RS can be integrally formal with tube 18. For example, seat RS and cage C may each comprise convex proturbences on the inside walls of tube 18 formed by corrugations in the tube wall as shown in FIG. 6. This greatly simplifies the fabrication of the check valve.

Prior art systems mentioned hereinbefore have no provision to prevent spillage due to the expansion of the head-space air.

Although the check valve described is one type suitable for the purpose, other means will be obvious to those skilled in the art, such as reed or duck-bill types. The check valve must in no case substantially impede the downward flow of the air through tube 18 which produces a balanced hydrostatic pressure at the desired location within the container. Therefore, other check valves which depend on mechanical means for bias in the closing direction must be made in such fashion that the biasing force is very low.

Since the check valve is used only during the life of the disposable container and is discarded along with the container there is no need for sanitizing the check valve between periods of use or between container changes. Judicious selection of materials and of the dimensional relationship between the ball and the resilient seat assures that the ball is covered with syrup when it moves to the closed position urged by the syrup, thus avoiding sticking of the valve while in use due to the drying of the syrup.

DESCRIPTION OF OPERATION

In operation, the disposable package 10 as illustrated in FIG. 1 is inverted into the position shown with open end 16 pointing downwardly and is inserted into the socket in the dispenser D whereby the neck of the package seals against O-ring seal D2 and thereafter membrane 20B is punctured by piercing device D3. Once in this position, frangible or sealed end portion 18B of tube 18 is broken or opened to permit the entry of air therethrough into container 12. As air flows through tube 18 into container 12 as the liquid is withdrawn, a pressure balance is created within the container and from this point on functions to control the flow of the syrup or other liquid at a constant rate from the container through the dispenser mechanism D and into receptacle or cup C. A constant rate of flow is achieved because tube 18 with air contained therein establishes an effective hydrostatic pressure head at point 18A in container 12 and thus, the flow rate of syrup from the container is substantially constant.

The disposable syrup package of the present invention may be manufactured with the tube 18 at different respective positions depending on the Brix valve of the syrup to be contained therein.

In other words, if a predetermined constant flow rate is desired it is necessary in determining the proper positioning of the open end 18A of tube 18 to take into consideration the Brix value of the syrup to be dispensed. However, the present invention offers the advantage that the positioning of tube 18 is done only by skilled and trained personnel in the manufacturing plant and not by any unskilled operator in the field at the point of use.

The disposable package 10 may be manufactured of any suitable materials. For example, the bottle 10 may be manufactured of thin plastic or glass, although plastic is preferred. The flow rate control tube 18 may also be manufactured of plastic or glass. The annular skirt portion 22 may be fabricated from the heavy duty high impact resistant plastic or rubber or formed as a part of the container itself. The rupturable membrane 20B provided in the open end 16 of container 12 may be metal foil, plastic, or any other suitable material which will seal the end of the container without contaminating its contents. If the membrane is plastic, it may be heat sealed to the end of the container 12.

In the preferred embodiments of the present invention the closed end 14 of the container is integral with the remaining portion and the closed end of the tube 18B is frangible. However, other modifications can be made within the spirit and scope of the present invention.

It should be understood that the package described herein may be further modified as would occur to one of ordinary skill in the art without departing from the spirit and scope of the present invention.

It is claimed:

1. A disposable package for dispensing liquids with a controlled rate of flow comprising:

a container having a closed end and a discharge end defining a discharge opening through which liquids may be dispensed;

a flow rate control tube having an openable sealed end and an open end, the tube extending substantially longitudinally of said container with the sealed end of said tube extending through said closed end of said container and said open end being disposed within said container at a predetermined distance from said discharge opening to control the flow rate of liquid through said discharge opening;

means associated with said closed end of said container for protecting said openable sealed end of said flow rate control tube from damage; and a frangible closure covering said discharge opening.

2. The package of claim 1, wherein said means for protecting comprises an annular skirt surrounding said closed end of said container and extending beyond said sealed end of said flow rate control tube, whereby said sealed end is recessed within said annular skirt.

3. The package of claim 1, wherein said means for protecting comprises a recessed wall portion in said closed end of said container, said openable sealed end of said flow rate control tube being disposed within the confines of said recessed wall portion.

4. The package of claim 1, wherein said frangible closure is covered by a removable cap.

5. The package of claim 1, wherein said openable sealed end comprises a frangible end wall in said flow rate control tube.

6. The package of claim 1, wherein valve means are provided for precluding the flow of liquid up and out of said flow rate control tube in response to a package temperature above a predetermined level, said valve means being actuated by direct contact with said fluid flowing up said flow rate control tube.

7. The package of claim 1, wherein valve means are provided adjacent said open end of said tube for precluding the flow of fluid up and out of said flow rate control tube in response to a package temperature above a predetermined level.

8. A disposable package for dispensing liquids with a controlled rate of flow comprising:

a container having a closed end and a discharge end defining a discharge opening through which liquids may be dispensed;

a flow rate control tube having an openable sealed end and an open end, the tube extending substantially longitudinally of said container with the sealed end of said tube extending through said closed end of said container and said open end being disposed within said container at a predetermined distance from said discharge opening to control the flow rate of liquid through said discharge opening;

means associated with said closed end of said container for protecting said openable sealed end of said flow rate control tube from damage; and means for precluding the flow of liquid up and out of said flow rate control tube in response to a package temperature above a predetermined level.

9. The package of claim 8, wherein said means comprises a check valve positioned in said flow rate control tube.

10. The package of claim 9, wherein said check valve includes a movable valve member, a cage for supporting said valve member in a first position corresponding to an open position of said check valve and a valve seat against which said valve member is positioned in a closed position of said check valve in response to the flow of liquid up said tube.

11. The package of claim 10, wherein said movable valve member is a ball.

12. The package of claim 10 wherein said cage and said valve seat are integrally formed corrugations in the walls of said flow rate control tube.

* * * * *